US006971548B2

(12) United States Patent
Smith

(10) Patent No.: US 6,971,548 B2
(45) Date of Patent: Dec. 6, 2005

(54) PUNCTURABLE SPOUT

(75) Inventor: Mark A. Smith, Plainfield, IL (US)

(73) Assignee: DS Smith Plastics Limited, London (GB)

( * ) Notice: Subject to any disclaimer, the term of this patent is extended or adjusted under 35 U.S.C. 154(b) by 9 days.

(21) Appl. No.: 10/384,816

(22) Filed: Mar. 10, 2003

(65) Prior Publication Data

US 2004/0178220 A1 Sep. 16, 2004

(51) Int. Cl.[7] ..... B67D 5/00
(52) U.S. Cl. ..... 222/83; 222/92
(58) Field of Search ..... 222/92, 95, 105, 222/107, 81, 83, 83.5, 88, 89

(56) References Cited

U.S. PATENT DOCUMENTS 3,474,933 A * 10/1969 Malpas ..... 222/90
4,325,496 A * 4/1982 Malpas ..... 222/83
4,765,511 A * 8/1988 Clements ..... 222/83
5,102,010 A * 4/1992 Osgar et al. ..... 222/82
5,205,440 A * 4/1993 Matsushita ..... 222/83

FOREIGN PATENT DOCUMENTS

GB 2077243 A * 12/1981 ..... B65D 47/36

* cited by examiner

*Primary Examiner*—Kenneth Bomberg

(74) *Attorney, Agent, or Firm*—Wallenstein Wagner & Rockey Ltd.

(57) ABSTRACT

The present invention provides a fitment assembly for a container including a spout connected in fluid communication to the container, a cap sealing an end of the spout, the cap having a pierceable portion, and a piercer for piercing the cap at the pierceable portion to permit fluid communication from the container through the spout and piercer.

12 Claims, 5 Drawing Sheets

PUNCTURABLE SPOUT

BACKGROUND OF THE INVENTION

This invention relates to filling flexible containers, and particularly to aseptically filling such containers. Flexible polymeric containers are well known for storing and dispensing wine, dairy products, enteral feeding solutions, fruit juices, tea and coffee concentrates, puddings, cheese sauces, and many other flowable materials, including those that must be filled aseptically. These generally include low acid materials. Flexible polymeric containers typically have walls made of polymeric films with either a monolayer or multiple layer structure. The particular polymers constituting the container film layers vary depending on the type of material to be placed in the container. The film layers may also include an oxygen barrier material layer to prevent contact between such materials and oxygen or other gas sensitive contents. The walls of the containers may be metallized, or coated with a metallic layer such as aluminum to prevent incursion of oxygen or other gases. A separate metallized enclosure may also encase the polymeric container.

The flexible polymeric containers have inlets and/or spouts for filling and dispensing the container contents. The containers are also often placed within a box. The spout extends through an opening in the box to dispense the contents. Such packaging systems are commonly referred to as "bag-in-box." Bag-in-box packaging systems are often used in restaurants and convenience stores to facilitate service of liquid food products such as syrups, toppings, and condiments.

After the container is filled with a desired material, the spout is capped to seal the container and protect the contents from contamination. Depending on the type of contents, the container, spout, cap, and contents may be heat sterilized using steam, an autoclave process, or similar method.

To access and dispense the contents of the container, the cap must be removed from the spout. Often, cap removal requires a tool to remove the cap because the sterilization process may cause the cap to be rigidly affixed to the spout. This presents a problem for end users. Tools are often misplaced or unavailable, making removal of the cap difficult. Moreover, a great deal of force is needed to remove the cap from the spout, causing potential spillage of the container contents.

For these reasons, a fitment for use with a flexible container which can be, easily assembled and installed into a dispensing system, and that minimizes effort in accessing the container's contents while also minimizing contamination of the contents is desired.

SUMMARY OF THE INVENTION

The present invention provides a fitment assembly for a container including a spout connected in fluid communication to the container, a cap sealing an end of the spout, the cap having a pierceable portion, and a piercer for piercing the cap at the pierceable portion to permit fluid communication from the container through the spout and piercer.

In another aspect, the present invention provides a method of dispensing fluid from a container, including the steps of providing a spout connected in fluid communication to the container, sealing an end of the spout with a cap, the cap having a pierceable portion, and piercing the cap at the pierceable portion to permit fluid communication from the container through the spout.

The present invention provides a fitment assembly and dispensing method that permits easy assembly, installation, and dispensing while minimizing opportunity for contamination of the container contents. Additional features and advantages of the present invention are described in, and will be apparent from, the following Detailed Description of the Invention and the figures.

DETAILED DESCRIPTION OF THE INVENTION

Figure 1:
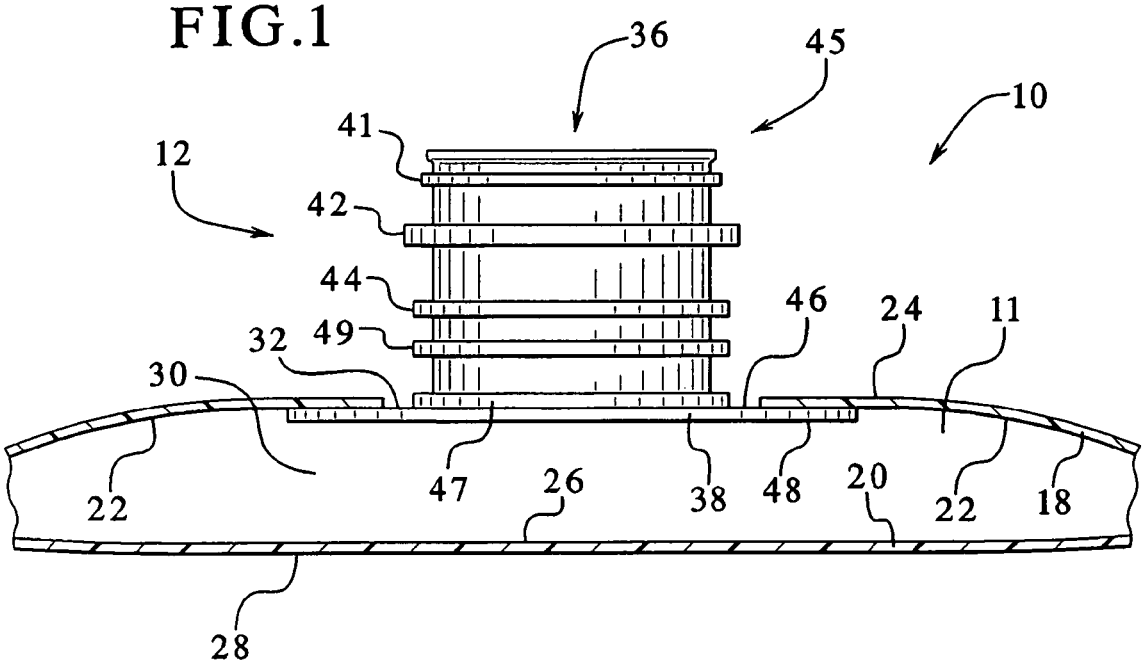
FIG. 1 is a schematic view of a spout and flexible container of an embodiment of the present invention.
Figure 2:
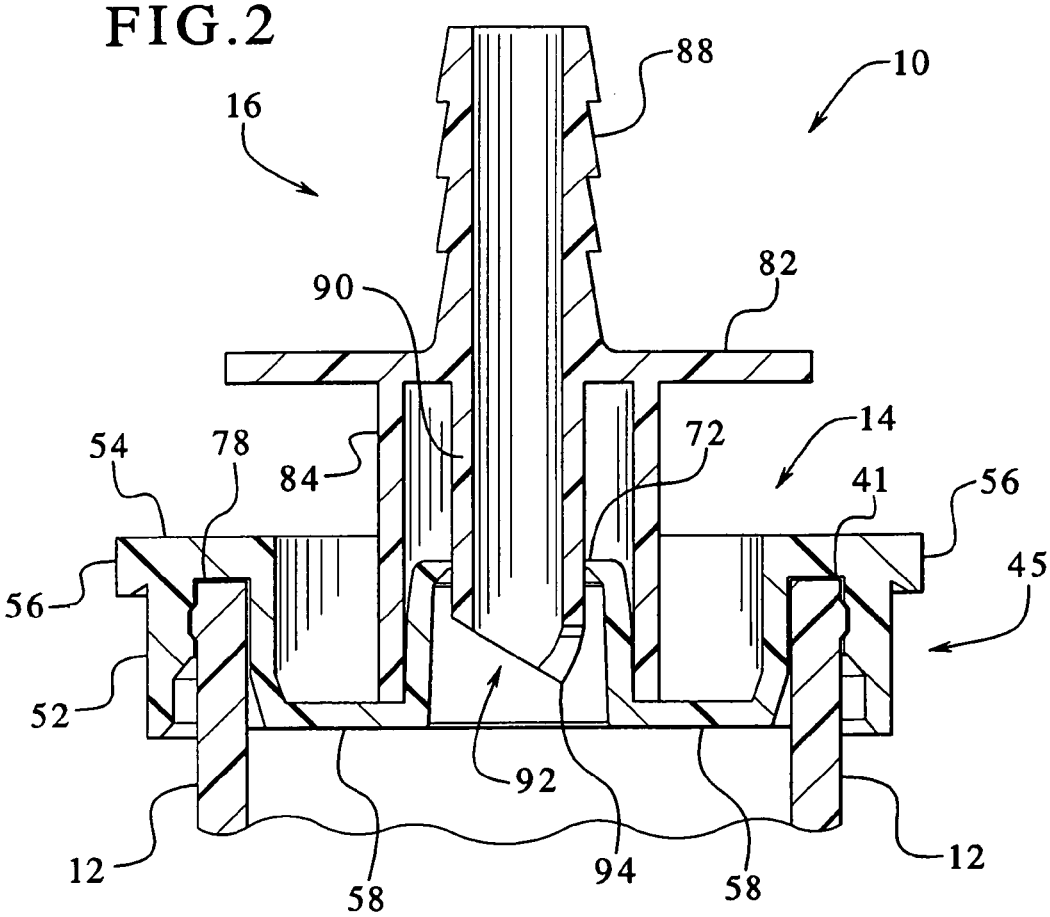
FIG. 2 is a cross-sectional view of a fitment assembly of an embodiment of the present invention.
Figure 3:
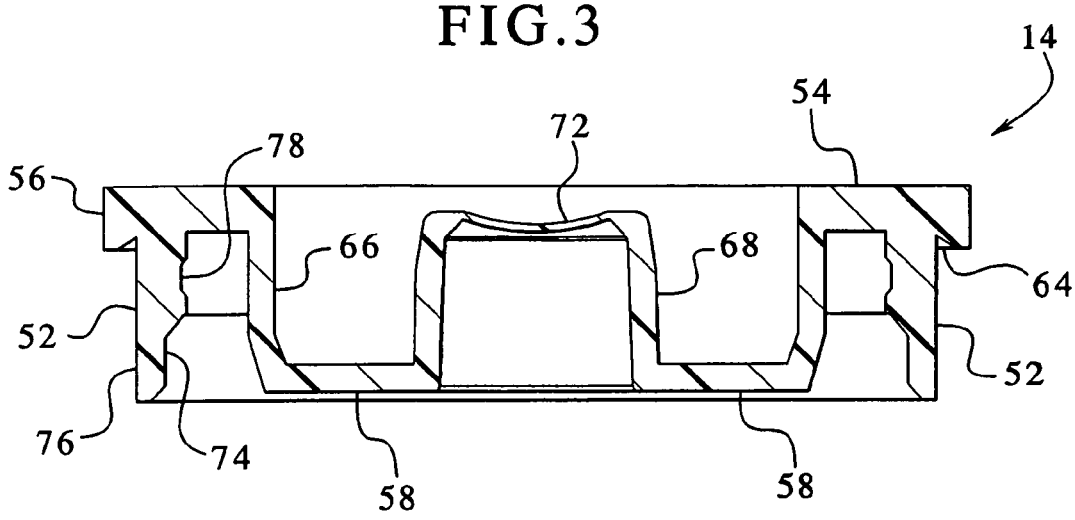
FIG. 3 is a cross-sectional view of a cap in accord with an embodiment of the present invention.

FIGS. 1 and 2 show a fitment assembly 10 of an embodiment of the present invention. The fitment assembly 10 includes a flexible container 11, a spout 12, a cap 14, and a piercer 16. In a preferred embodiment, the flexible container 11 has a front wall 18 and a back wall 20. The front wall 18 has an inner surface 22 and an outer surface 24. The back wall 20 has an inner surface 26 and an outer surface 28. The front wall 18 and back wall 20 of the flexible container 11 are sealed along their periphery 30. The flexible container 11 can be formed by placing the front wall 18 and back wall 20 into registration and sealing the front wall 18 and back wall 20 together along their periphery to form a liquid tight chamber 30. Any suitable means to attach the front wall 18 and back wall 20 may be used, but they are preferably heat sealed. It is also contemplated that the flexible container 11 can be fabricated using a blown tube extrusion process where longitudinal ends of the tube are sealed to form the liquid tight chamber 30.

The front wall 18 and back wall 20 may be of any suitable material depending on the contents to be stored in the flexible container 11. Preferably, the front wall 18 and back wall 20 are formed from a polymeric material such as polyethylene, polyvinyl chloride (PVC), polyolefins, polyamides, polyesters, ethylene vinyl acetate (EVA) to name but a few. The front wall 18 and back wall 20 can be monolayer structures or multiple layer structures. The multiple layer structures can be formed by coextrusion, extrusion, lamination, extrusion lamination, or other processes well known in the art. In a preferred embodiment, the front wall 18 and back wall 20 are made of a single layer of polyethylene. In another embodiment, the front wall 18 and back wall 20 are made of two laminated layers of polyethylene. The front wall 18 has an opening 32 generally centrally disposed on the front wall 18 that accommodates the fitment assembly 10. The opening 32, however, may be suitably located anywhere within the front wall 18.

The spout 12 has a base 38 and defines a passageway 36. In a preferred form of the invention, the base 38 is flat and generally circular shaped, but may be of any suitable shape such as rectangular. The base 38 has a front surface 46 and a back surface 48. The base 38 is attached to the inner surface 22 of the front wall 18 at the front surface 46.

The spout 12 has a generally circular cross-sectional shape, but may be of any suitable shape such polygonal or oval. The spout 12 is generally centrally disposed on the base, and preferably extends in a perpendicular direction from the base 38. Disposed and spaced along the length of the spout 12 are a locking flange 41, a first flange 42, a second flange 44, and a third flange 49. The locking flange 41, is located at a second end 45 of the spout 12 opposite the base 38. The first flange 42 is located toward the base 38 from the locking flange 41. The second and third flanges 44 and 49 are located at suitable positions between the base 38 and the first flange 42. The locking flange 41, first flange 42, second flange 44, and third flange 49 extend around the circumference of the spout 12, and are integral with the spout 12. The first flange 42 is preferably wider than the second and third flanges 44 and 49. The first, second, and third flanges 42, 44, and 49 may accommodate docking to filling equipment, or a fluid access device such as a dispenser accommodated in the passageway 36. A fourth circumferential flange 47 is integral with the base 38.

The spout 12, base 38, and first, second, and third flanges 42, 44, and 49 are made of any suitable material, but are preferably made of rigid polymeric materials and more preferably are selected from polypropylenes, polyethylenes, polyamides, polycarbonates, polyesters, polyester ethers, polyester elastomers, polystyrenes, acrylonitrile butadiene styrene block copolymers (ABS), polyethylene terephthalate or other rigid polymeric material that can be heat sealed to front wall 18 of the flexible container 11.

As shown in FIGS. 2–6, the spout 12 has a cap 14 at it second end 45. The cap 14 may be formed integral with the spout 12, but more preferably, is a separate piece attached to the second end 45 of the spout 12 by any suitable means. The cap 14 may be made of the same materials as the spout 12, including those described above with respect to the spout 12. Preferred materials for the cap 14 include high density polyethylene, low density polyethylene, and polypropylene.

The cap 14 includes a center portion 70 at the center 62 of the cap 14. The center portion 70 includes a pierceable portion 72 located preferably generally at or about its center 62. The purpose of the pierceable portion 72 will be described below. The pierceable potion 72 may include indenting 73 in its surface to facilitate piercing. The cap 14 also includes a concentric depression 58 disposed about the center portion 70. The depression 58 forms annular outer wall 66 and annular inner wall 68. Outer wall 66 is located radially outward from inner wall 68. The center portion 70 is located at the top of the inner wall 68.

Cap 14 also includes a concentric platform 54 disposed about the concentric depression 58. The platform 54 has a circumference 64. The platform 54 is located at and extends from the top of the outer wall 66. The cap 14 further includes an annular skirt 52 extending perpendicularly downward from the platform 54. The platform 54 includes a lip 56 extending perpendicularly outward from the skirt 52. The annular skirt 52 has an inner surface 74 and an outer surface 76. The inner surface 74 includes a locking ring 78. The locking ring 78 is circumferential, and mates with locking flange 41 of the outer surface of the second end 45 of the spout 12 to seat the cap 14 on the spout 12 as shown in FIG. 2.

In a preferred embodiment, the cap 14 may be made in a two-part injection process where the pierceable portion 72 is of a material that is more easily pierced than the remainder of the cap 14. In a further preferred embodiment, the pierceable portion 72 may also be made of a material that is pliable such that it may provide sealing between the piercer 16 and cap during communication of fluid through the piercer 16 after it has pierced the pierceable portion 72. In this preferred embodiment, the pierceable portion 72 is made of a thermoplastic elastomer (TPE). The remainder of the cap 14 may be made of materials such as HDPE or LDPE, or any suitable more rigid material. The more rigid material in the remainder of the cap 14 permits positive engagement to the spout 12, and increases the ability of the remainder of the cap 14 to withstand the high temperature environment of steam sterilization.

Figure 4:
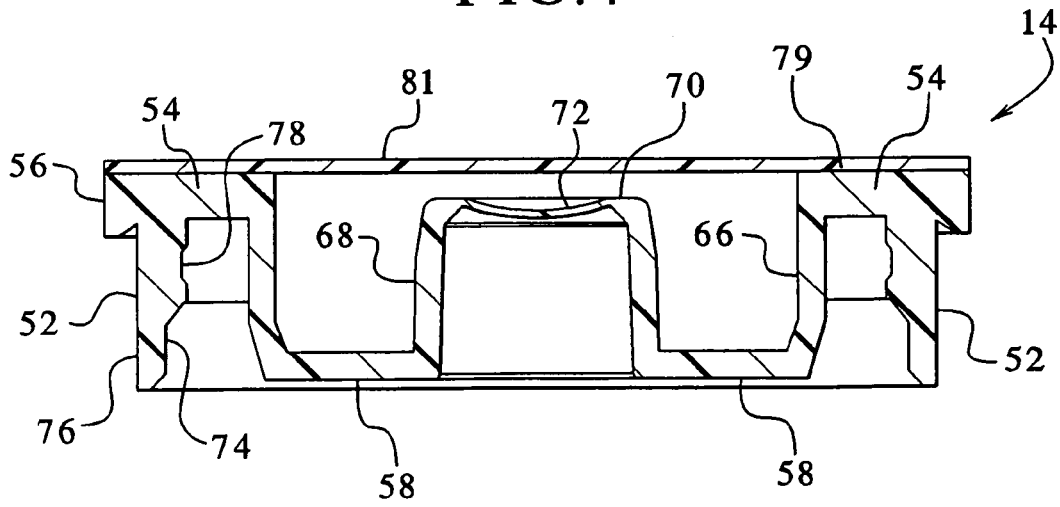
FIG. 4 is a cross-sectional view of a cap in accord with an embodiment of the present invention.
Figure 5:
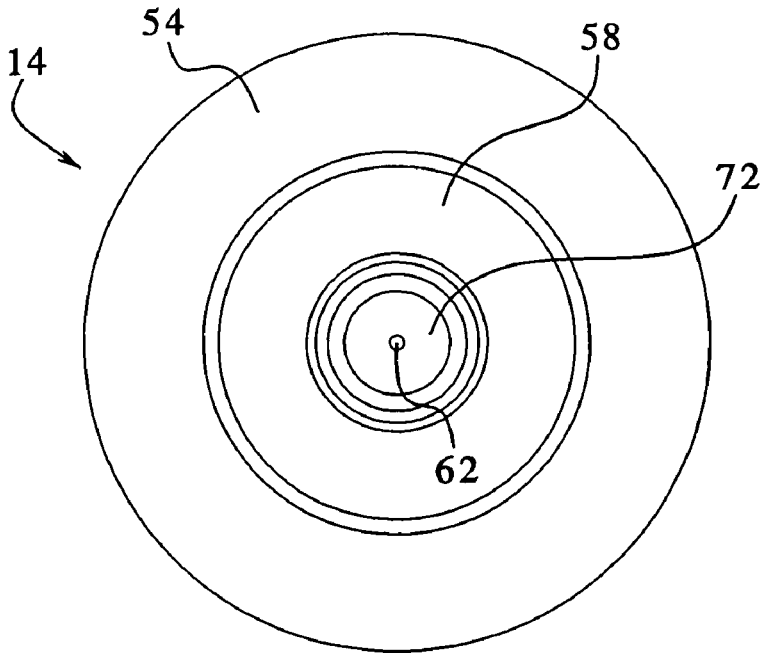
FIG. 5 is a top view of a cap in accord with an embodiment of the present invention.
Figure 6:
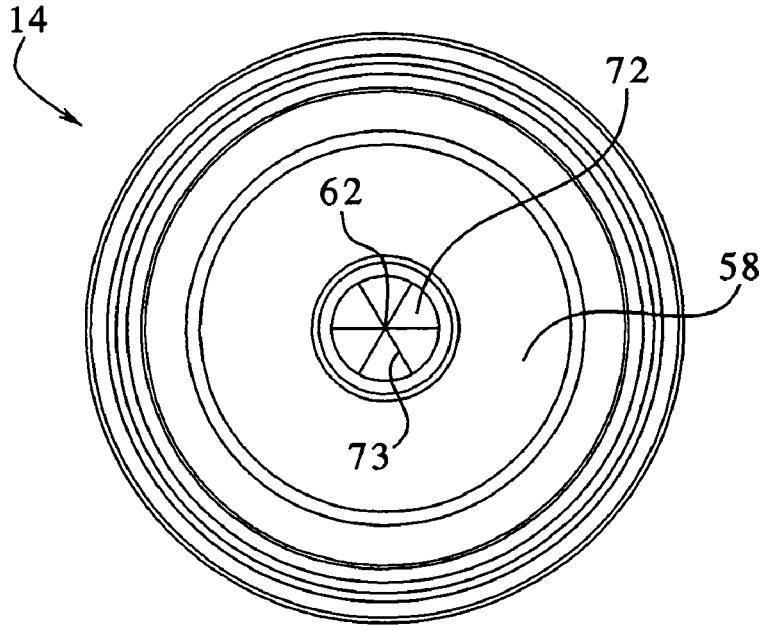
FIG. 6 is a bottom view of a cap in accord with an embodiment of the present invention.
Figure 7:
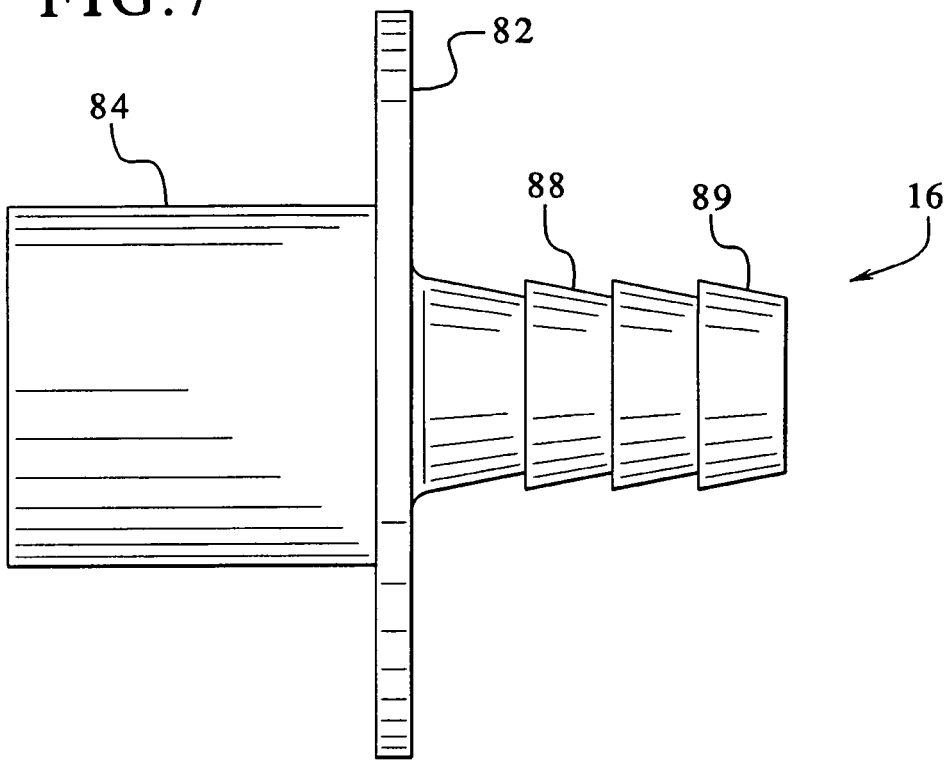
FIG. 7 is a side view of a piercer in accord with an embodiment of the present invention.
Figure 8:
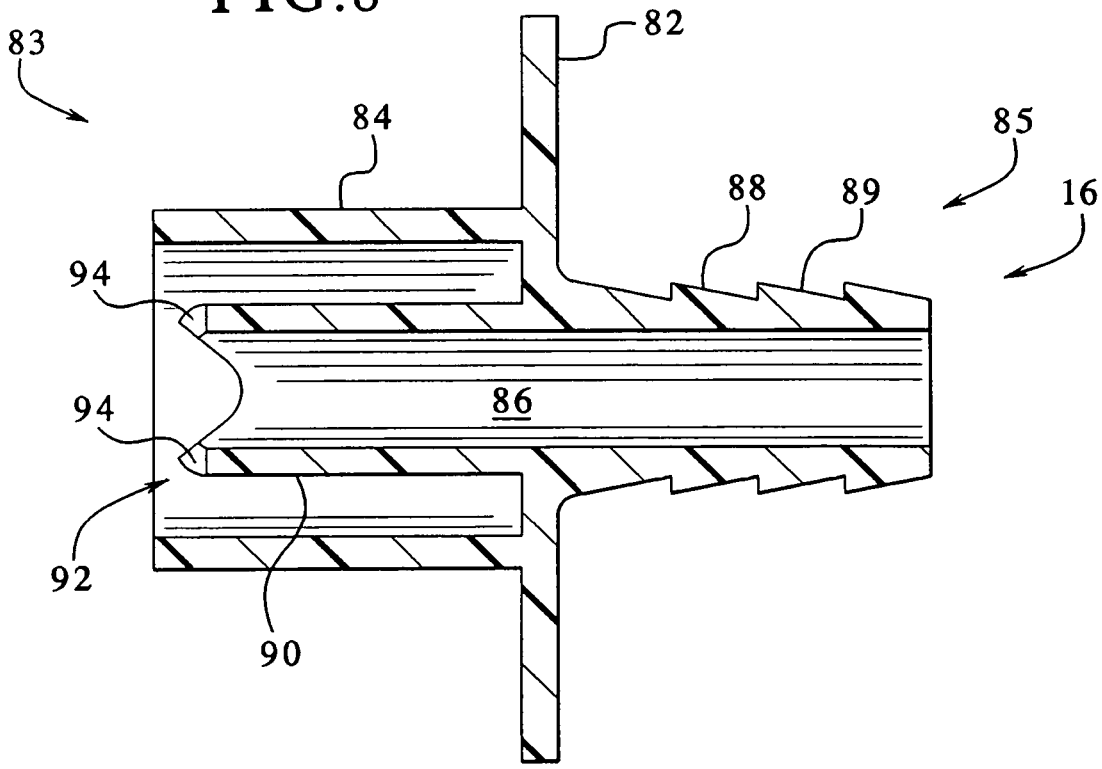
FIG. 8 is a cross-sectional view of a piercer in accord with an embodiment of the present invention.
Figure 9:
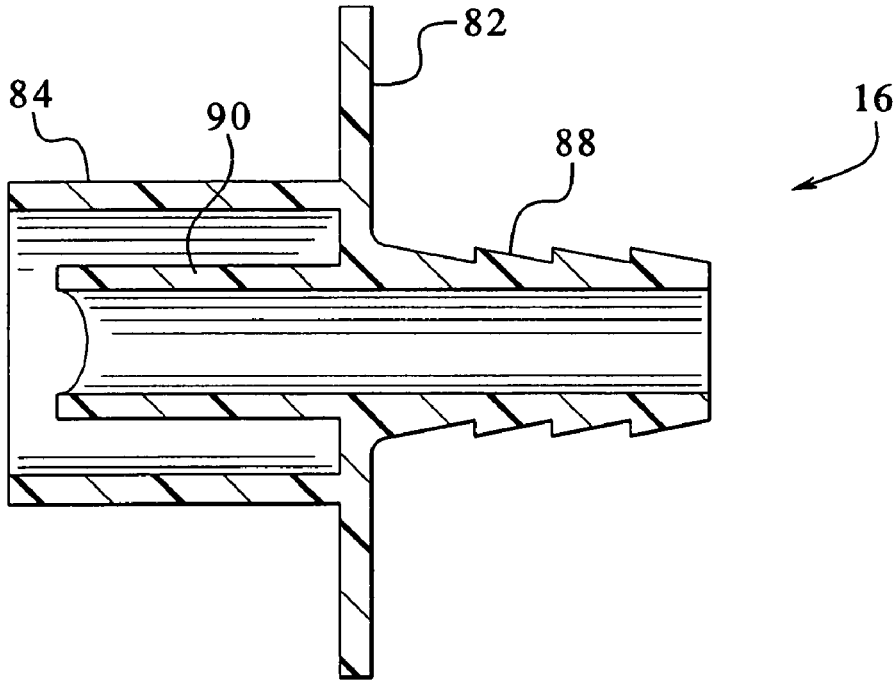
FIG. 9 is a cross-sectional view of a piercer in accord with an embodiment of the present invention.
Figure 10:
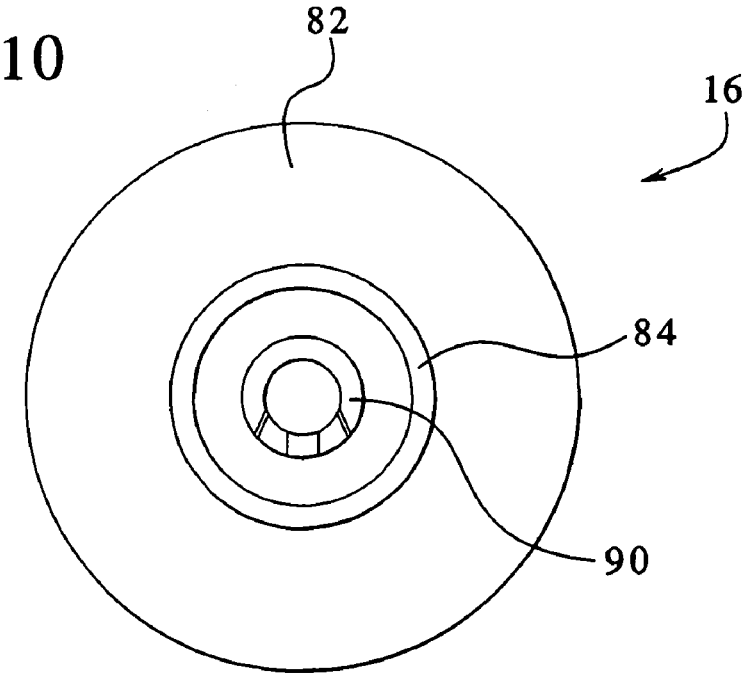
FIG. 10 is a bottom view of a piercer in accord with an embodiment of the present invention.

Attached to the top 79 of the cap 14 is a barrier 81. (FIG. 4). The barrier 81 covers at least a portion of the exterior surface of the cap 14 to protect the pierceable portion 72 and cap 14 from contaminants during shipment and handling of the flexible container 11. Preferably, the barrier 81 covers at least all of the pierceable portion 72. The barrier 81 made be made of any suitable material, including polymeric materials such as polyamides, polyester, or polyvinylidene chloride containing films. In a preferred embodiment, the barrier 81 may be substantially gas or oxygen impermeable, and the barrier 81 may include a material selected to provide a gas or oxygen barrier superior to the cap 14 material or the pierceable portion 72. This will enhance the shelf life of the product stored in the flexible container 11. The gas or oxygen barrier material can include foil, ethylene vinyl alcohol, polyvinyl alcohol, polyethylene, or a metalized polyester laminate depending on required heat resistance characteristics, but can be any suitable material. In a preferred embodiment, the barrier 81 is made of a metal foil adhered to the exterior surface of the top 79 of the cap 14. In a preferred embodiment, the barrier 81 is adhered to the exterior surface of the top 79 of the cap 14 by heat sealing, but can be attached by ultrasonic welding or other known methods. The barrier 81 material is preferably coated with the same material of which the cap 14 is made to enhance sealing characteristics.

The material of the barrier 81 is also preferably selected to withstand heat from steam sterilization, and serves to protect the pierceable portion 72 from heat during steam sterilization, acting as a heat shield or deflector to protect the pierceable portion 72 from the steam heat. The barrier 81 also preferably provides a sterile zone around the pierceable portion 72 to reduce possible contaminants to the contents of the container 11 during piercing of the pierceable portion 72 by the piercer 16.

As shown in FIGS. 7–10, the piercer 16 includes a main circumferential flange 82. The piercer 16 has a piercing end 83 and a nozzle end 85. At the piercing end 83, and extending perpendicularly from and below the flange 82 is an outer flange ring 84. The circumferential flange 82 has an opening 86 extending through its center. At the nozzle end 85, and disposed about and communicating with the opening 86 is a nozzle 88. The nozzle 88 extends perpendicularly from the main flange 82. The nozzle 88 can include ribbing 89, which can be used to secure tubing for dispensing contents of the container 11 as will be later described.

Disposed and encompassed by the flange ring 84 is a piercing piece 90. The piercing piece 90 extends perpendicularly from the main flange 82, is preferably cylindrical, but may be any suitable shape, and is disposed about and in communication with the opening 86 in the flange 82. The piercing piece 90 is preferably shorter than the outer flange ring 84. At a distal end 92 of the piercing piece 90 are sharpened portions 94. The distal end 92 of the piercing piece 90 maybe angled to enhance piercing as shown in FIG. 2. The purpose of the sharpened portions 94 will become apparent in the description to follow. The piercer may be made of any suitable material, including those described above for the spout 12 and cap 14. It is desirable that the piercer 16, and in particular the piercing piece 90 be made of a material sufficiently rigid as compared to the cap 14 to permit it to pierce the cap 14. A preferred material for the piercer 16 is polypropylene.

The method of the present invention proceeds as follows. The spout 12 is attached to the flexible container 11. The flexible container 11 is filled with the desired contents through the spout 12. After filling, the cap 14 with the barrier 81 already attached is placed onto the second end 45 of the spout 12. The cap 14 is pressed onto the spout 12 such that the locking ring 78 engages the locking flange 41 located on the spout 12. At this or any suitable point, the cap 14 and barrier 81 may be steamed to decontaminate them.

When a user desires to access the contents of the flexible container 11, the user removes the barrier 81. The user then inserts the flange ring 84 of the piercer 16 into the depression 58 of the cap 14. The user applies pressure to the main flange 82, and the sharpened portions 94 of the piercing piece 90 contact the pierceable portion 72 at the center 70 of the cap 14. Further pressure of the sharpened portions 94 against the pierceable portion 72 causes them to pierce the pierceable portion 72 of the cap 14. This permits fluid communication between the contents of the flexible container 11 through the piercing piece 90 and nozzle 88. The contents of the flexible container 11 can be directed using a tube (not shown) attached to the nozzle 88. The piercer 16 is held to the cap 14 by press fit between the inner surface of the flange ring 84 and the outer surface of the inner wall 68 of the cap 14. This also permits easy removal upon emptying the contents of the container 11.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A fitment assembly for a container comprising:

a spout connected in fluid communication to the container, a cap sealing an end of the spout, the cap having a pierceable portion, and a piercer for piercing the cap at the pierceable portion to permit fluid communication from the container through the spout and piercer, wherein the cap further includes a center portion, the center portion containing the pierceable portion, a concentric depression about the center portion, a concentric platform about the concentric depression, the platform having a circumference, and an annular skirt extending perpendicularly downward from the circumference of the platform.

2. The fitment assembly of claim 1, wherein the concentric platform includes a lip extending perpendicularly outward from the skirt.

3. The fitment assembly of claim 1, wherein the concentric depression forms annular inner and outer walls, and the center portion is located at the top of the inner wall, and the platform extends from the outer wall.

4. The fitment assembly of claim 1, wherein the annular skirt includes and inner surface and an outer surface, and the inner surface includes a locking portion.

5. The fitment assembly of claim 4 wherein the locking portion includes a circumferential ring, and the spout includes a locking flange adapted to mate with the circumferential ring.

6. The fitment assembly of claim 1, wherein the piercer has a piercing end and a nozzle end.

7. The fitment assembly of claim 6, wherein the nozzle end includes a nozzle.

8. The fitment assembly of claim 6, further comprising a tube attached to the nozzle end.

9. The fitment assembly of claim 7, wherein the nozzle is ribbed.

10. The fitment assembly of claim 1, wherein the spout has a base, and the spout is generally centrally disposed on the base, and extends in a perpendicular direction from the base.

11. The fitment assembly of claim 1, wherein the piercer is attachable to the cap.

12. A fitment assembly for a container comprising:

a spout connected in fluid communication to the container, a cap sealing an end of the spout, the cap having a pierceable portion and a center portion, the center portion containing the pierceable portion, a concentric depression about the center portion, a concentric platform about the concentric depression, the platform having a circumference, and an annular skirt extending perpendicularly downward from the circumference of the platform, and a piercer for piercing the cap at the pierceable portion to permit fluid communication from the container through the spout and piercer, the piercer including a main circumferential flange having an opening, an outer flange ring extending perpendicularly from the main circumferential flange, the outer flange ring disposed about the opening, a nozzle extending perpendicularly from the main circumferential flange in a direction opposite from the outer flange ring, the nozzle disposed about the opening, and a piercing piece extending perpendicularly from the main circumferential flange, the piercing piece disposed about the opening, and encompassed within the outer flange ring.

* * * * *